US010221011B2

(12) United States Patent
Stone

(10) Patent No.: US 10,221,011 B2
(45) Date of Patent: Mar. 5, 2019

(54) BEAR-RESISTANT WASTE DISPOSAL CONTAINERS

(71) Applicant: RS Welding and Fabrication LLC, Hayden, CO (US)

(72) Inventor: James Rollin Stone, Hayden, CO (US)

(73) Assignee: RS Welding and Fabrication LLC, Hayden, CO (US)

( * ) Notice: Subject to any disclaimer, the term of this patent is extended or adjusted under 35 U.S.C. 154(b) by 0 days.

(21) Appl. No.: 15/590,460

(22) Filed: May 9, 2017

(65) Prior Publication Data

US 2017/0320667 A1 Nov. 9, 2017

Related U.S. Application Data

(60) Provisional application No. 62/333,814, filed on May 9, 2016.

(51) Int. Cl.

| | |
|---|---|
| ***B65F 1/16*** | (2006.01) |
| ***E05B 65/00*** | (2006.01) |
| *B65F 1/14* | (2006.01) |
| *E05B 63/14* | (2006.01) |

(52) U.S. Cl.

CPC ..... *B65F 1/1615* (2013.01); *E05B 65/006* (2013.01); *B65D 2543/00101* (2013.01); *B65D 2543/00277* (2013.01); *B65D 2543/00296* (2013.01); *B65D 2543/00574* (2013.01); *B65F 1/14* (2013.01); *B65F 1/16* (2013.01); *B65F 2001/1653* (2013.01); *E05B 63/143* (2013.01)

(58) Field of Classification Search

CPC ..... B65F 1/1615–1/1646; B65F 2001/1653–2001/1692; E05B 65/006; E05B 63/143; B65D 2543/00574; B65D 2543/00296; B65D 2543/00277; B65D 2543/00101

USPC ..... 220/324, 328, 908–911

See application file for complete search history.

(56) References Cited

U.S. PATENT DOCUMENTS

| | | | | |
|---|---|---|---|---|
| 4,593,873 | A * | 6/1986 | Nelson | B65B 67/1211 220/263 |
| 5,033,520 | A * | 7/1991 | Kuehmichel | B65F 1/1468 141/231 |
| 5,735,428 | A * | 4/1998 | Chern | B65D 45/24 190/120 |
| 6,086,073 | A * | 7/2000 | Tisbo | B25H 1/02 280/47.26 |

(Continued)

OTHER PUBLICATIONS

Stensland, "Device could lock down trash from bears," Steamboat Today, Oct. 2, 2015, retrieved from http://www.steamboattoday.com/news/2015/oct/02/device-could-lock-down-trash-bears/, 3 pages.

(Continued)

*Primary Examiner* — Kareen K Thomas
(74) *Attorney, Agent, or Firm* — Sheridan Ross P.C.

(57) ABSTRACT

A bear-resistant waste disposal container comprises a bin, a handle, and a lid rotatably connected to the handle. A bin collar surrounds an upper perimeter of the bin, and a lid collar surrounds an outer perimeter of the lid. A picket extends upwardly from inside the bin, through an aperture in the lid, and through an aperture in a lid frame. A carabiner or other locking device is removably insertable through an opening in the upper portion of the picket to lock the lid in a closed position.

18 Claims, 14 Drawing Sheets

(56) References Cited

U.S. PATENT DOCUMENTS

| | | | | |
|---|---|---|---|---|
| 7,100,791 | B2 | 9/2006 | Berger | |
| 7,225,943 | B2 * | 6/2007 | Yang | A61L 9/014 220/23.9 |
| 7,748,558 | B2 * | 7/2010 | Rouns | B65F 1/1615 220/326 |
| 2011/0049152 | A1 * | 3/2011 | Raghunathan | B65F 1/1468 220/263 |
| 2013/0032597 | A1 * | 2/2013 | Anderson | B65F 1/1468 220/324 |
| 2014/0034645 | A1 * | 2/2014 | Jackson | B65F 1/141 220/260 |
| 2018/0037407 | A1 * | 2/2018 | Hyytinen | B65F 1/1405 |
| 2018/0101028 | A1 * | 4/2018 | Stevens | G02C 7/085 |

OTHER PUBLICATIONS

Stensland, "Welder tries to keep the bears out," Steamboat Today, May 3, 2016, retrieved from http://www.steamboattoday.com/news/2016/may/03/welder-trying-keep-bears-out/, 4 pages.

* cited by examiner

BEAR-RESISTANT WASTE DISPOSAL CONTAINERS

CROSS-REFERENCE TO RELATED APPLICATIONS

This application claims the benefit, under 35 U.S.C. § 119(e), of U.S. Provisional Patent Application No. 62/333,814, entitled "BEAR-RESISTANT WASTE DISPOSAL CONTAINERS" and filed on May 9, 2016, which is hereby incorporated by reference herein in its entirety.

FIELD

The present disclosure is generally directed to waste disposal containers, and more specifically to waste disposal containers that are configured to prevent bears and other wildlife from accessing the contents thereof.

BACKGROUND

Waste disposal containers come in a variety of shapes and sizes, are made of a variety of materials, and may be adapted for a variety of purposes, including indoor and outdoor use. Common indoor residential waste containers are generally made of plastic materials and have a capacity in the range of one to thirty gallons. Outdoor waste disposal containers tend to be larger, with common residential waste disposal containers ranging in capacity from fifty to one hundred gallons. Many waste disposal containers include a bin that collects and holds waste, and a lid. The lid can be removed or opened when adding waste to the bin, but otherwise remains closed, so as to contain odors emanating from the waste as well as to keep the waste out of sight. With outdoor waste disposal containers in particular, the container lid also prevents the contents of the bin from being blown out of the container by wind, and prevents small animals such as dogs, cats, raccoons, and birds from accessing and/or removing the contents of the container.

U.S. Pat. No. 7,100,791, the entirety of which is incorporated by reference herein, describes a hinged lid trash can for curbside refuse pickup. The can is equipped with wheels to facilitate movement of the can from a residence to a curbside location for pickup. The wheels are positioned adjacent the rear bottom corners of the can, at a sufficient height to barely contact the ground (or to not contact the ground) when the can is in a resting position. When the can is rotated backward, the wheels contact the ground and bear the weight of the can, such that the can may be more easily moved from one location to another. The can also includes a reinforced flange and a latch bar on the front wall of the can. A refuse truck with a mechanical arm can then use the mechanical arm to engage the flange and latch bar of the can and lift the can into the air. The mechanical arm inverts the can over the truck's refuse bin, where the force of gravity causes the lid to swing open and the contents of the can to fall into the refuse bin. As the can is lowered to the ground by the mechanical arm, the lid swings back into a closed position.

In certain areas, waste disposal containers are needed that not only prevent access to the contents thereof by small animals, but also by bears and other large animals. Bears are known to have a keen sense of smell, and are often attracted to the smell of food from waste disposal containers. However, access to full garbage cans by bears can be dangerous to both bears and humans. Accordingly, various waste disposal containers have been designed to prevent bears from gaining access to the content thereof. For example, U.S. Pat. No. 7,748,558 describes a latch for a refuse container that utilizes a complicated system of plates, springs, cables, and rods to prevent access to the refuse container by a bear.

SUMMARY

Existing bear-proof or bear-resistant waste disposal containers tend to be expensive, complicated, or ineffective. Many such containers are purpose-built to be bear-resistant or bear-proof. However, the market for bear-resistant waste disposal containers generally, and for bear-resistant residential curbside waste disposal containers in particular, is significantly smaller than the market for non-bear-resistant residential curbside waste disposal containers. As a result, purpose-built bear-resistant waste-disposal containers cannot benefit from the same economies of scale as non-bear-resistant waste disposal containers, such that they tend to be more expensive than non-bear-resistant waste disposal containers. The cost of making a bear-resistant waste disposal container can be lowered by retrofitting existing waste disposal containers, but known retrofits tend to be complicated—which adds to cost and reduces reliability—and/or unable to prevent bears from accessing the contents of the container. It is with respect to these and other issues that the embodiments presented herein were contemplated.

Bear-resistant waste disposal containers according to embodiments of the present disclosure provide a simple and economical solution for preventing bears from accessing waste and refuse inside the container.

According to one embodiment of the present disclosure, a bear-resistant waste container comprises a bin, a lid, a bin collar, a lid frame, at least one picket, and a locking device. The bin comprises an outer wall; an open top surrounded by a substantially horizontal surface; and a handle extending from the outer wall near the open top. The lid is movably connected to the bin and movable between a closed position and an open position, and comprises an upper surface surrounded by a downwardly extending perimeter, wherein a bottom portion of the downwardly extending perimeter is adjacent the substantially horizontal surface when the lid is in the closed position; and at least one lid aperture in the upper surface. The bin collar is fixedly secured to at least a portion of a perimeter of the substantially horizontal surface, and extends vertically above the substantially horizontal surface by at least one half of one inch. The lid frame is positioned adjacent the lid and comprises at least one connection member that allows the lid frame to move with the lid; at least one frame member fixedly secured to the at least one connection member; and at least one plate member comprising at least one plate aperture and fixedly secured to the at least one frame member, the at least one plate member positioned to align the at least one plate aperture with the at least one lid aperture. The at least one picket is fixedly secured to the outer wall and configured to extend upward past the open top and through the lid aperture and the plate aperture when the lid is in the closed position. The at least one picket comprises an opening in an upper portion thereof. The locking device is attached to one of the bin, the lid, the bin collar, and the lid frame, and is removably insertable through the opening of the at least one picket to secure the lid in the closed position.

The lid may be rotatably connected to the handle of the bin. The bottom portion of the downwardly extending perimeter may contact the substantially horizontal surface when the lid is in the closed position. The bear-resistant waste container may further comprise a lid collar fixedly secured to at least a portion of an outer surface of the downwardly extending perimeter, the lid collar comprising a lower edge substantially aligned with a lower surface of the downwardly extending perimeter, such that the lower edge is lower than an upper edge of the bin collar when the lid is in the closed position. The bin collar and the lid collar may be made of steel.

The lid frame may be rotatably connected to the handle. The picket may comprise a plate portion fixedly secured to an attachment plate, the plate portion positioned on an inner surface of the outer wall and the attachment plate positioned on an outer surface of the outer wall. The bear-resistant waste container may further comprise an attachment mechanism fixedly secured to an attachment plate, the attachment mechanism position on an outer surface of the outer wall and the attachment plate positioned on an inner surface of the outer wall. The locking device may be a carabiner. The locking device may comprise a biased member. The bin collar, the lid frame, and the picket may be formed of a different material than the bin. The bin may further comprise an axle secured to a bottom portion of the bin, and two wheels rotatably mounted on the axle. The bear-resistant waste container may further comprise at least two lid apertures in the upper surface of the lid; at least two pickets; and at least two locking devices.

According to another embodiment of the present disclosure, a reinforced garbage can comprises a bin for receiving garbage, a reinforcing frame secured to the bin, a picket, and a locking device. The bin comprises an interior volume defined by a bottom surface and an outer wall; an open top; and a lid attached to the outer wall near the open top, the lid comprising an upper surface with a first aperture therein, the lid movable between an open position in which the interior volume is accessible and a closed position in which the interior volume is inaccessible. The reinforcing frame comprises at least one frame member positioned adjacent an upper surface of the lid; and at least one plate member fixedly secured to the at least one frame member, the at least one plate member comprising a second aperture. The picket is fixedly secured to the outer wall and positioned to extend upwardly through the first and second apertures when the lid is in the closed position. The picket comprises an opening positioned above the second aperture when the lid is in the closed position. The locking device is selectively insertable through the opening of the picket to prevent the picket from passing through the second aperture, thus securing the lid in the closed position.

The outer wall may further comprise a handle, and the lid may be rotatably attached to the handle. The reinforcing frame may comprise a rotatable connection member rotatably attached to the handle, and the at least one frame member may be fixedly secured to the rotatable connection member. The picket may be further fixedly secured to an attachment plate positioned on an opposite side of the outer wall from the picket. The reinforced garbage can may further comprise a bin collar fixedly secured to the outer wall and having an upper edge at least one half of one inch above the open top; and a lid collar fixedly secured to a downwardly extending perimeter of the lid and having a lower edge, so that when lid is in the closed position, the bin collar is positioned outside of the lid collar, and the upper edge of the bin collar is higher than the lower edge of the lid collar.

A bear-resistant waste disposal container according to yet another embodiment of the present disclosure comprises a bin, a handle, a lid, a bin collar, a lid collar, a picket, a lid frame, a locking device, and an attachment mechanism. The bin comprises a bottom surface; a front wall; a rear wall; a first side wall; a second side wall; and an open top surrounded by a substantially horizontal surface. The handle extends from the rear wall near the open top. The lid is rotatably connected to the handle and movable between a closed position and an opened position. The lid comprises an aperture in an upper surface of the lid; and a downwardly extending perimeter, at least a portion of which contacts the substantially horizontal surface when the lid is in the closed position. The bin collar is fixedly secured to at least a portion of a perimeter of the substantially horizontal surface, and extends vertically above the substantially horizontal surface by at least one half of an inch. The lid collar is fixedly secured to at least a portion of an outer surface of the downwardly extending perimeter. The lid collar comprises a lower edge substantially aligned with a lower surface of the downwardly extending perimeter, such that the lower edge is lower than an upper edge of the bin collar when the lid is in the closed position. The at least one picket comprises an upper portion having an opening therein, the upper portion extending vertically through the aperture of the lid; and a lower portion comprising a picket plate, the picket plate fixedly secured to one of the front wall, the first side wall, or the second side wall of the bin. The lid frame comprises at least one rotatable connection member rotatably connected to the handle; at least one frame member fixedly secured to the rotatable connection member; and at least one plate member comprising a second aperture, the at least one plate member fixedly secured to the at least one frame member and positioned so that the upper portion of the at least one picket extends through the second aperture of the plate member when the lid is in the closed position. The locking device is attached to one of the lid frame, the lid, the bin, and the handle, and is removably insertable through the opening of the picket to lock the lid in the closed position. The attachment mechanism is fixedly secured to the rear wall of the bin. The bin collar and the lid collar may be made of steel.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying pictures and drawings are incorporated into and form a part of the specification to illustrate several examples of the present disclosure. These pictures and drawings, together with the description, explain the principles of the disclosure. The pictures and drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the pictures and drawings referenced below.

DETAILED DESCRIPTION

Figure 1:
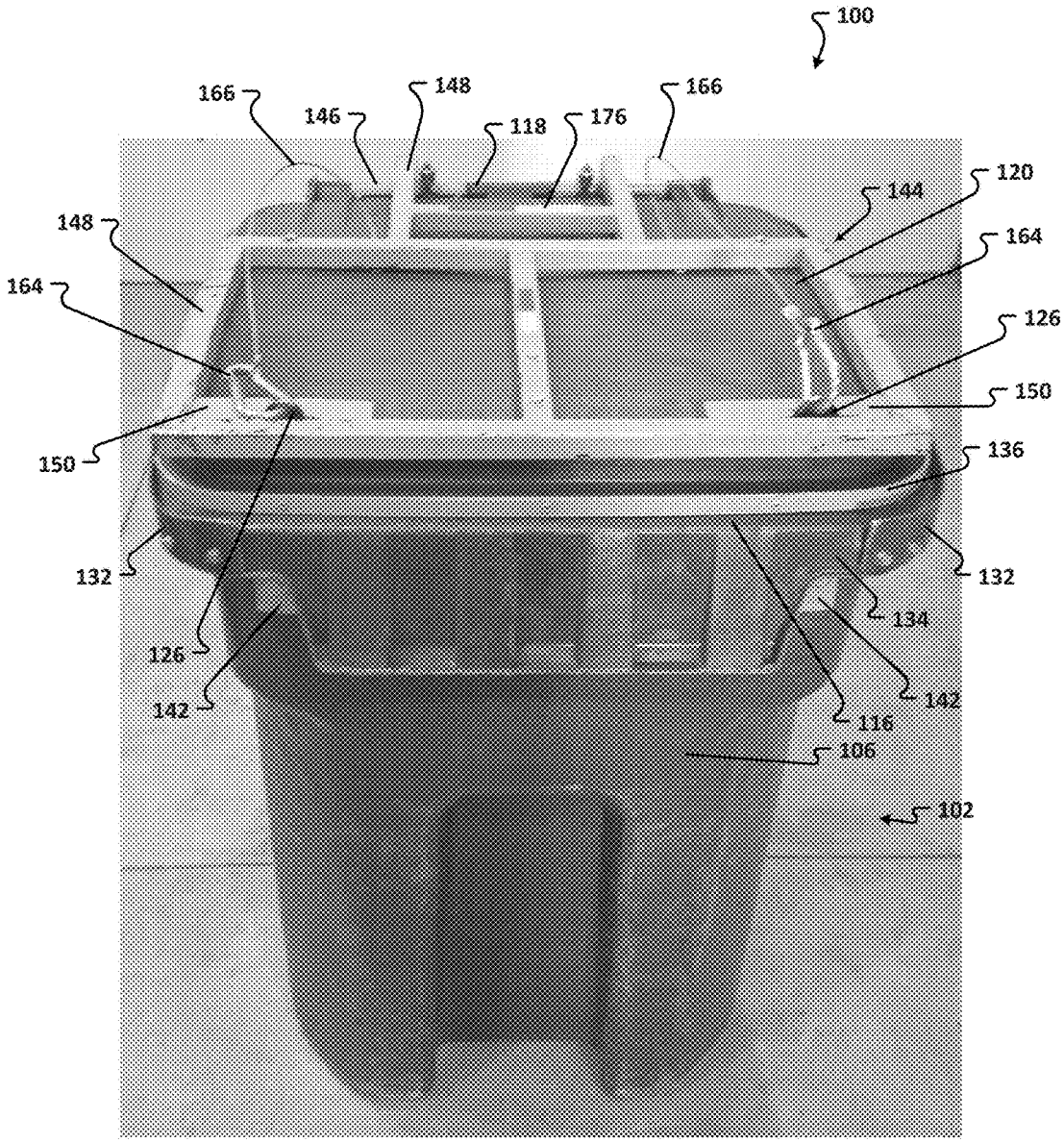
FIG. 1 is a view of the front of a bear-resistant waste disposal container according to one embodiment of the present disclosure.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Additionally, the use of examples (which may be indicated by language including "for example," "by way of example," "such as," "e.g." or the like) is intended to illustrate possible implementations of the embodiments of present disclosure, but is not intended to be limiting.

According to one embodiment of the present disclosure, and with reference to FIGS. 1-5 and 7-14, a bear-resistant waste disposal container 100 comprises a bin 102 with a substantially flat bottom surface 104, a front wall 106, a rear wall 108, a first side wall 110, a second side wall 112, and an open top 114 surrounded by a substantially horizontal surface 116. The front wall 106, rear wall 108, first side wall 110, and second side wall 112 constitute a continuous outer wall that, together with the bottom surface 104, defines an interior volume of the waste disposal container 100. A bin according to other embodiments may have a single wall (e.g. a circular wall), portions of which may or may not be identified in relation to the handle. For example, in a bin having a circular wall, the portion of the circular wall from which the handle extends may be the rear wall or surface, the opposite portion may be the front wall or surface, and portions in between the front and rear walls or surfaces may be the side walls or surfaces.

Figure 3:
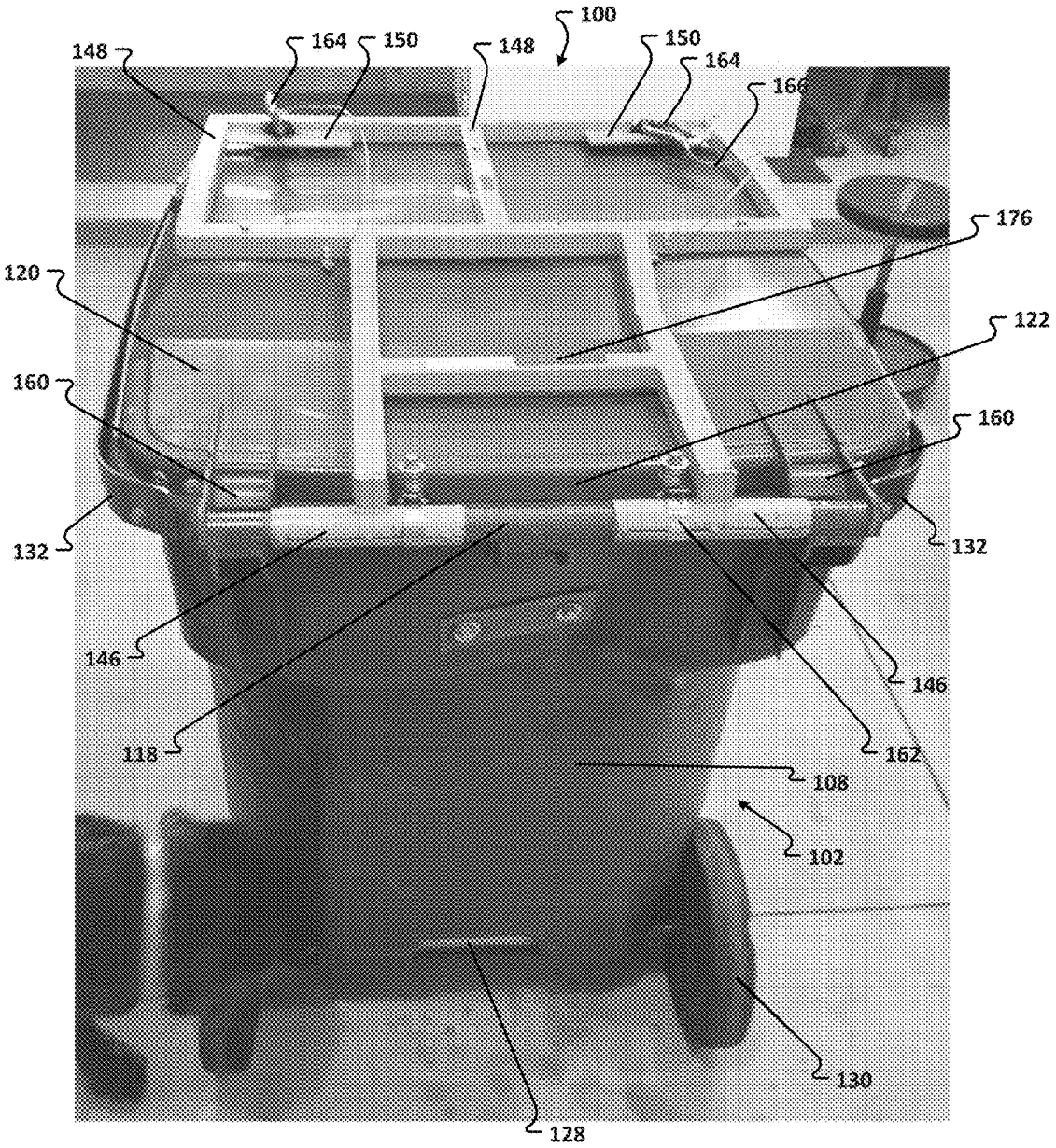
FIG. 3 is a view of the rear of the bear-resistant waste disposal container of the embodiment of FIG. 1.

The container 100 further comprises a handle 118 extending away from the upper rear wall 108 of the bin 102, and a lid 120 hingedly attached to the handle 118 (see, e.g., FIG. 3). In some embodiments, the handle 118 is an elongated cylinder or tube mounted parallel to the rear wall or surface 108 of the bin 102. The lid 120 comprises a downwardly extending lip 122 around the perimeter thereof that contacts (or almost contacts) the substantially horizontal flat surface 116 surrounding the open top 114 when the lid 120 is in a closed position, in which position the lid 120 covers the open top 114 of the bin 102. The lid 120 also comprises at least one aperture 124 (see, e.g., FIG. 11) to accommodate at least one picket 126, which is further described below. In some embodiments, the bear-resistant waste disposal container 100 also comprises an axle 128 affixed to a lower portion of the rear surface or wall 108 of the bin 102, or to the bottom surface 104, the axle 128 supporting one wheel 130 on each end thereof (see, e.g., FIG. 5). In some embodiments, each wheel 130 may be rotatably mounted to the axle 130. In other embodiments, each wheel may be fixedly secured to the axle 130, and the axle 130 may be rotatably secured to the bin 102 (whether via a bearing or otherwise).

In some embodiments, the bin 102 and the lid 120 of the waste disposal container 100 are made of the same material, while in other embodiments the bin 102 and the lid 120 are made of different materials. In some embodiments, one or both of the bin 102 and the lid 120 are made of heavy-duty plastic, such as high density polyethylene. The heavy-duty plastic may be, for example, one-eighth of an inch thick, one quarter of an inch thick, or three-eighths of an inch thick.

Figure 4:
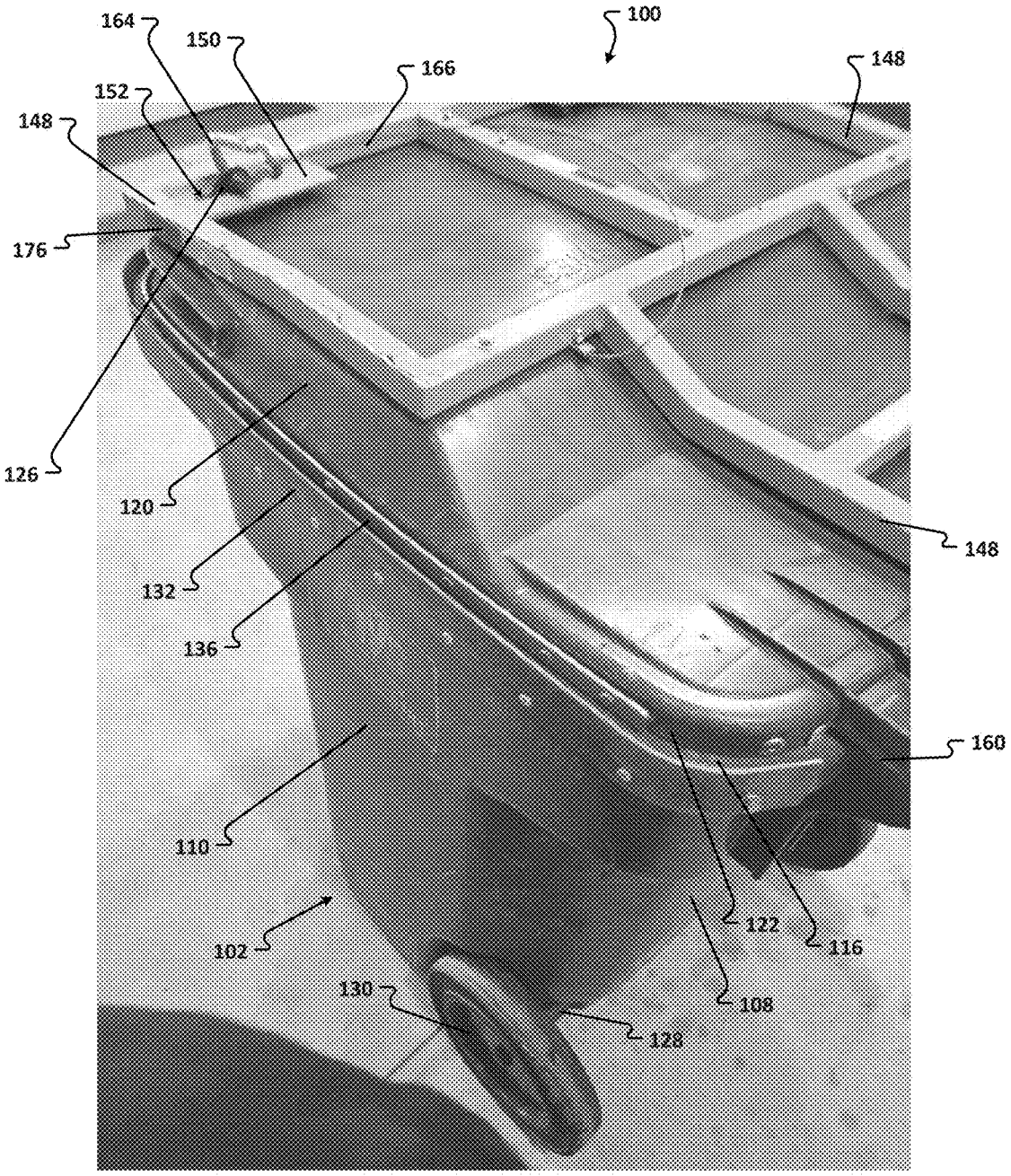
FIG. 4 is a view of a portion of the top and side of the bear-resistant waste disposal container of the embodiment of FIG. 1.
Figure 8:
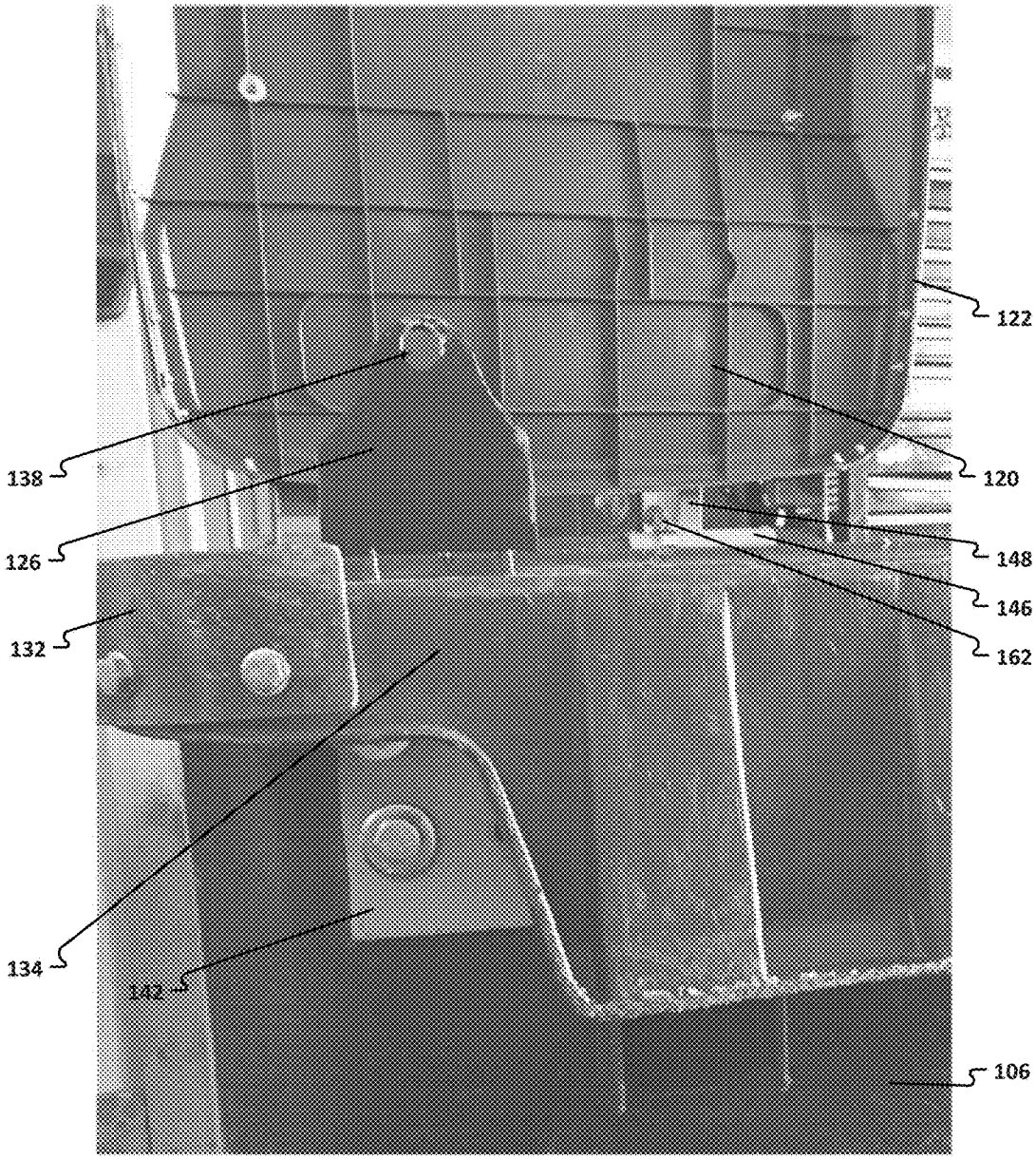
FIG. 8 is a close-up view of a portion of the front surface of the bear-resistant waste disposal container of the embodiment of FIG. 1 with the lid open, showing a picket extending upwardly above the substantially horizontal surface as well as a portion of a bin collar.

The bin 102 of the bear-resistant waste disposal container 100 further comprises a bin collar 132 secured to a vertical outer perimeter 134 of the bin 102, surrounding at least a portion of the open top 114 and the substantially horizontal surface 116 (see, e.g., FIGS. 4, 8). The bin collar 132 extends above the substantially horizontal surface 116 (see, e.g., FIGS. 8-10). The bin collar 132 may extend above the substantially horizontal surface 116 by at least one half inch, by at least three quarters of an inch, or by at least one inch. The bin collar 132 may be secured to the vertical outer perimeter 134 of the bin 102 by one or more bolts, rivets, screws, or any combination thereof. In some embodiments, the bin collar 132 may be bolted to the vertical outer perimeter 134 near the ends of the bin collar 132, and riveted to the vertical outer perimeter 134 along the length of the bin collar 132 (e.g. between the bolt or bolts on one end of the bin collar 132 and the bolt or bolts on the other end of the bin collar 132). In embodiments, the bolts and/or rivets and/or screws used to secure the bin collar 132 to the vertical outer perimeter 134 of the bin 102 may be spaced from each other by at least one inch, or by at least two inches, or by at least three inches, or by at least four inches. The bin collar 132 may have a vertical dimension of at least one inch, or of at least one and a half inches, or of at least two inches. The bin collar 132 may have a thickness of at least one sixteenth of an inch, or of at least one eighth of an inch, or of at least three sixteenths of an inch, or of at least one quarter of an inch, or of at least three eighths of an inch. The bin collar 132 may be made of steel, aluminum, a carbon-fiber composite, high-density polyethylene, or any other suitable material.

Figure 2:
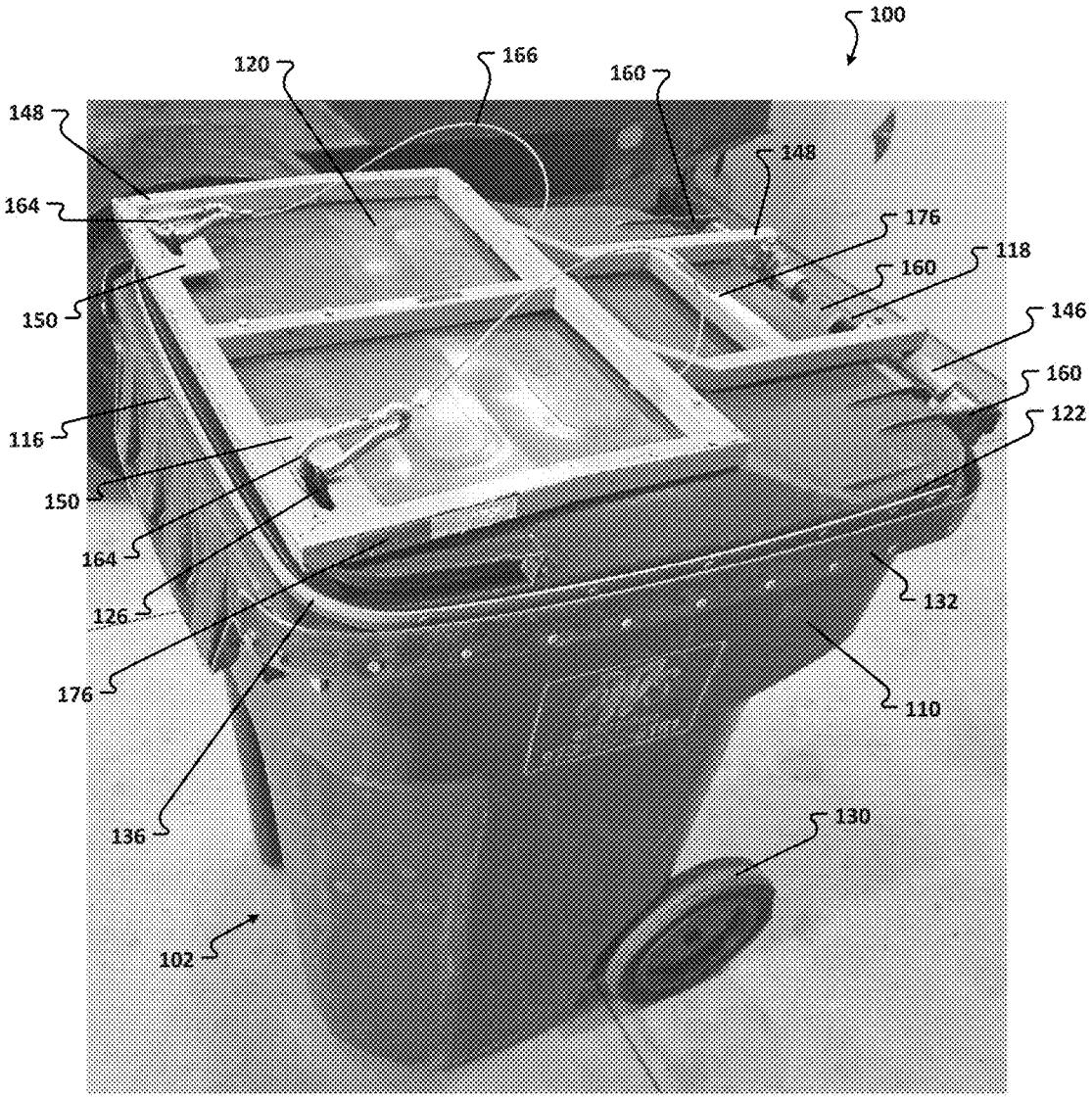
FIG. 2 is a perspective view of the bear-resistant waste disposal container of the embodiment of FIG. 1.

In some embodiments, the waste disposal container 100 comprises two bin collars 132, each secured to a portion of the vertical outer perimeter 134 of the bin 102 (see, e.g., FIGS. 1-3). For example, one bin collar 132 may be secured to the vertical outer perimeter 134 of the first side 110 of the bin 102, and another bin collar 132 may be secured to the vertical outer perimeter 134 of a second side 112 of the bin 102. The first side 110 may be opposite the second side 112. Additionally, the bin collars 132 may extend the length of the first side 110 and the second side 112, and may each extend along a portion of a third side (e.g. the front wall 106) and/or a fourth side (e.g. the back wall 108) of the bin 102.

The bear-resistant waste disposal container 100 also comprises a lid collar 136 that extends around and is secured to at least a portion of the downwardly extending lip 122 of the lid 120, which forms a vertical perimeter of the lid 120 (see, e.g., FIGS. 1, 2, and 4). The lid collar 136 comprises a lower edge that is substantially aligned with the lowest surface of the downwardly extending lip 122 of the lid 120. The lid collar 136 extends upwardly from the lower edge by at least one half inch, or by at least one inch, or by at least one and a half inches. The lid collar 136 may be secured to the downwardly extending lip 122 of the lid 120 by one or more bolts, rivets, screws, or any combination thereof (see, e.g., FIG. 11). In some embodiments, the lid collar 136 may be bolted to the downwardly extending lip 122 of the lid 120 near the ends of the lid collar 136, and riveted to the downwardly extending lip 122 of the lid 120 along the length of the lid collar 136 (e.g. between the bolt or bolts on one end of the lid collar 136 and the bolt or bolts on the other end of the lid collar 136). In embodiments, the bolts and/or rivets and/or screws used to secure the lid collar 136 to the downwardly extending lip 122 of the lid 120 may be spaced from each other by at least one inch, or by at least two inches, or by at least three inches, or by at least four inches, or by at least five inches, or by at least six inches. The lid collar 136 may have a thickness of at least one sixteenth of an inch, or of at least one eighth of an inch, or of at least three sixteenths of an inch, or of at least one quarter of an inch, or of at least three eighths of an inch. The lid collar 136 may be made of steel, aluminum, a carbon-fiber composite, high-density polyethylene, or any other suitable material.

In some embodiments, the waste disposal container 100 comprises two lid collars 136, each secured to a portion of the downwardly extending lip 122 of the lid 120. For example, one lid collar 136 may be secured to the portion of the downwardly extending lip 122 of the lid 120 corresponding to the first side wall 110 of the bin 102, and another lid collar 136 may be secured to the portion of the downwardly extending lip 136 of the lid 120 corresponding to the second side wall 112 of the bin 102. Additionally, the lid collars 136 may extend along the length of at least one side of the lid 120 and along a portion of one or more other sides of the lid 120.

The bin collar 132 and the lid collar 136 of the bear-resistant waste disposal container 100 may overlap vertically by at least one quarter of an inch, or by at least one half of an inch, or by at least three quarters of an inch, or by at least one inch (see, e.g., FIG. 4). Additionally, the perpendicular distance between the lid collar 136 and the bin collar 132 (e.g. the distance along a line that is perpendicular to the plane of the lid collar 136 and the plane of the bin collar 132) may be less than one-half inch, or less than three quarters of an inch, or less than one inch. In some embodiments, the bin and lid collars 132 and 136 may be attached to the bin 102 and lid 120, respectively, using an adhesive, whether alone or in combination with the other attachment means described above. In other embodiments, the bin and lid collars 132 and 136 may be integrally formed with the bin 102 and lid 120, respectively, at the time of manufacture. For example, if the lid 120 is formed of plastic and the lid collar 136 of steel, the plastic may be formed around the steel during the manufacture of the lid 120.

Also included in the bear-resistant waste disposal container 100 is at least one picket 126 fixedly attached to an inside surface of the bin 102 and extending upward through the open top 114 of the bin 102 and through the aperture 124 of the lid (see, e.g., FIGS. 1-4, 7-10). The picket 126 may extend above the upper surface of the lid 120 by at least one inch, or by at least one and a half inches, or by at least two inches, or by at least two and a half inches. The upper portion of the picket 126 (i.e. the portion that extends above the upper surface of the lid 120) comprises an opening 138 (see, e.g., FIG. 10). The lower portion of the picket 126 comprises a plate 140 that may be fixedly secured to an inside surface of the bin 102 (see, e.g., FIG. 10). The plate 140 may be, for example, secured to the inside surface of the bin 102 using an adhesive, and/or using one or more bolts and/or screws. In embodiments where the bin 102 is made of plastic and the plate 140 of metal, the metal plate 140 may be heated to a temperature that causes the plastic to soften or melt, then pressed into the plastic and allowed to cool. Additionally or alternatively, an attachment plate 142 may be positioned on an outside surface of the bin 102, opposite the plate 140 of the picket 126. The picket plate 140 may then be bolted or otherwise attached to the attachment plate 142 through the wall of the bin 102, such that the wall of the bin 102 is sandwiched between the picket plate 140 and the attachment plate 142. In embodiments, the picket plate 140 may be bolted to the attachment plate 142 using one bolt, or using two bolts, or using three bolts, or using four bolts (see, e.g., FIGS. 8-10).

Figure 9:
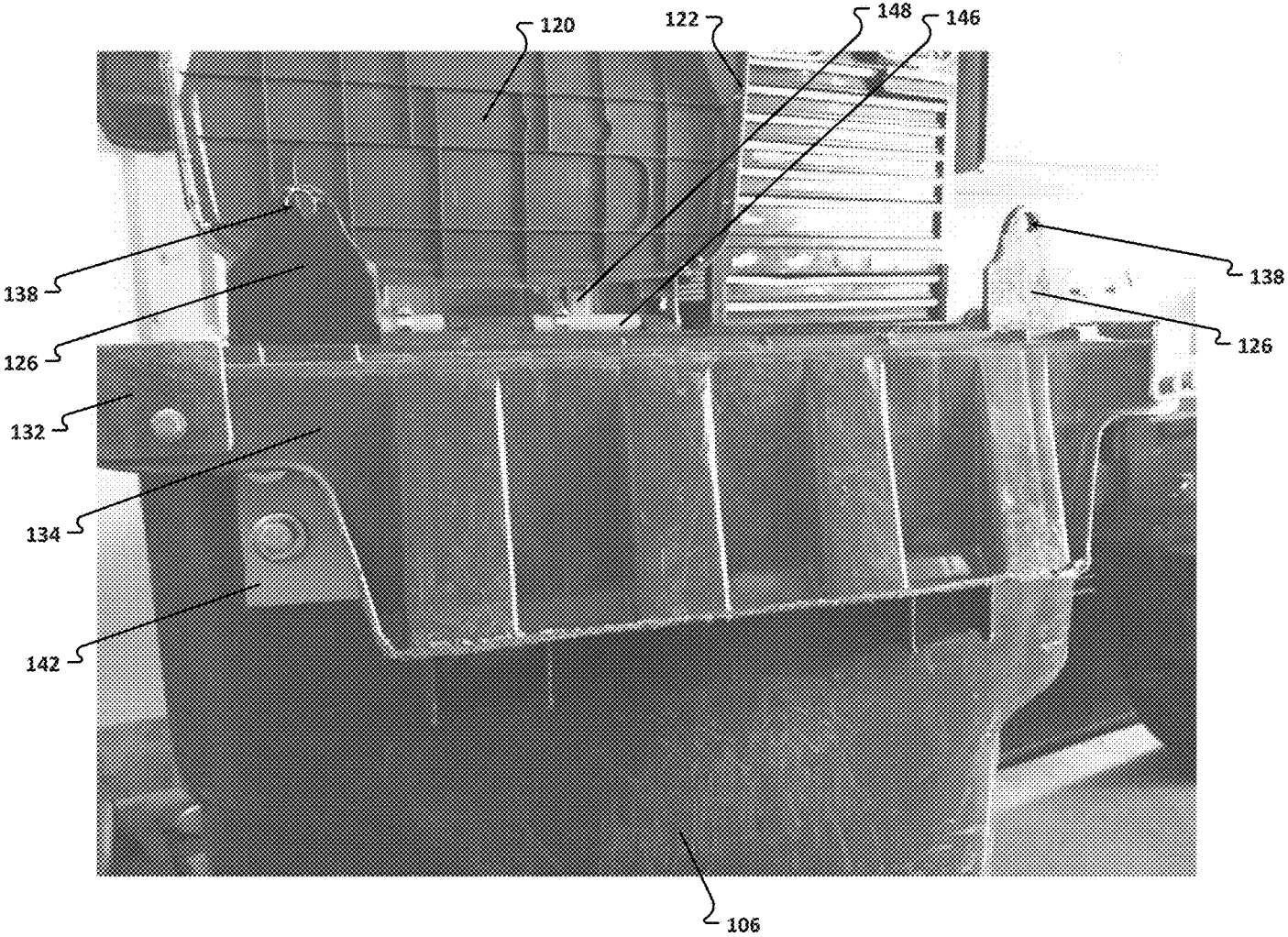
FIG. 9 is a front view of the upper portion of the bin of the bear-resistant waste disposal container of the embodiment of FIG. 1 with the lid open, showing two pickets extending upwardly above the substantially horizontal surface.
Figure 10:
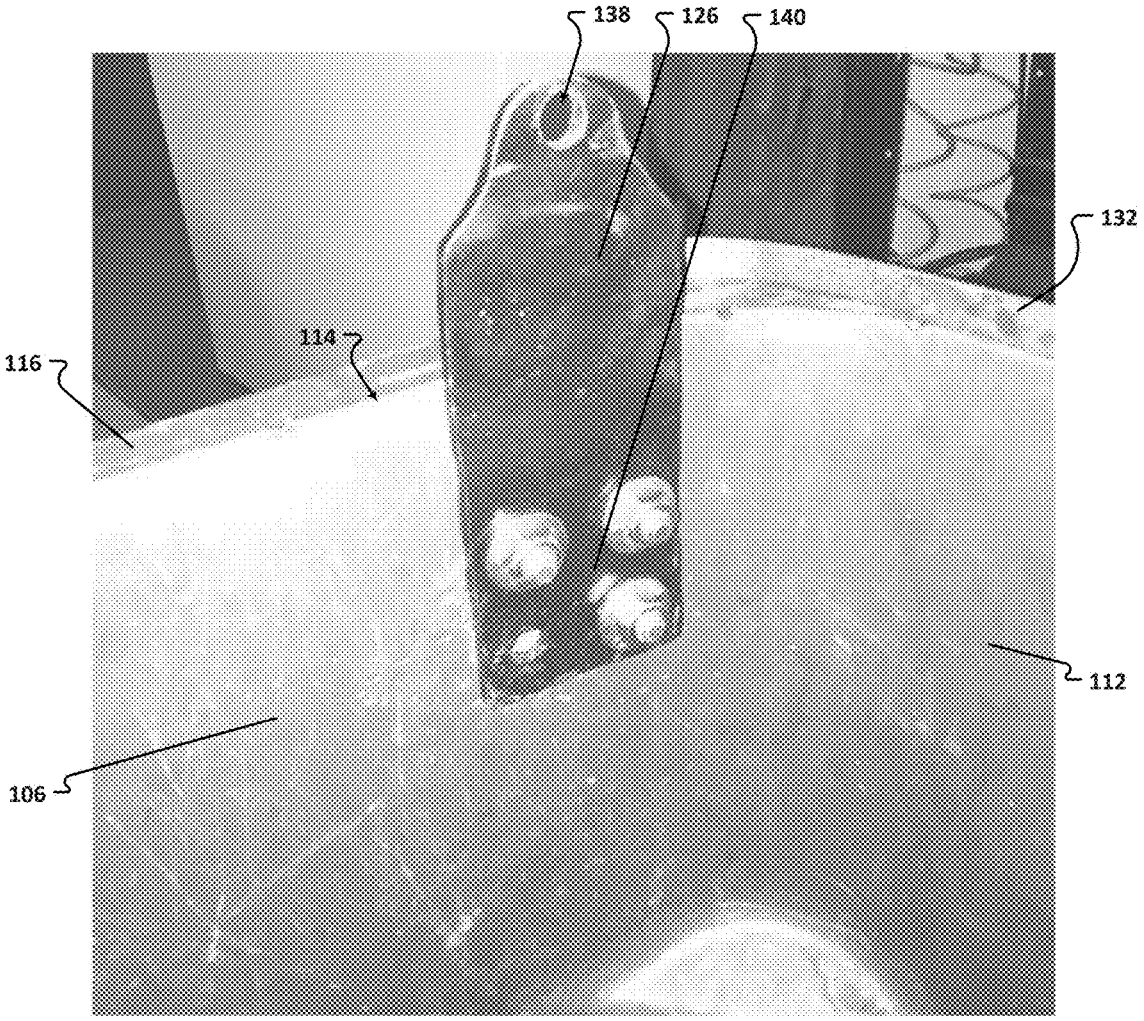
FIG. 10 is a close-up view of a picket of the bear-resistant waste disposal container of the embodiment of FIG. 1, showing the lower portion fixedly secured to the front inner surface of the waste disposal container and the upper portion extending upwardly above the substantially horizontal surface with an opening therein, and further showing a portion of a bin collar extending upwardly above the substantially horizontal surface.
Figure 11:
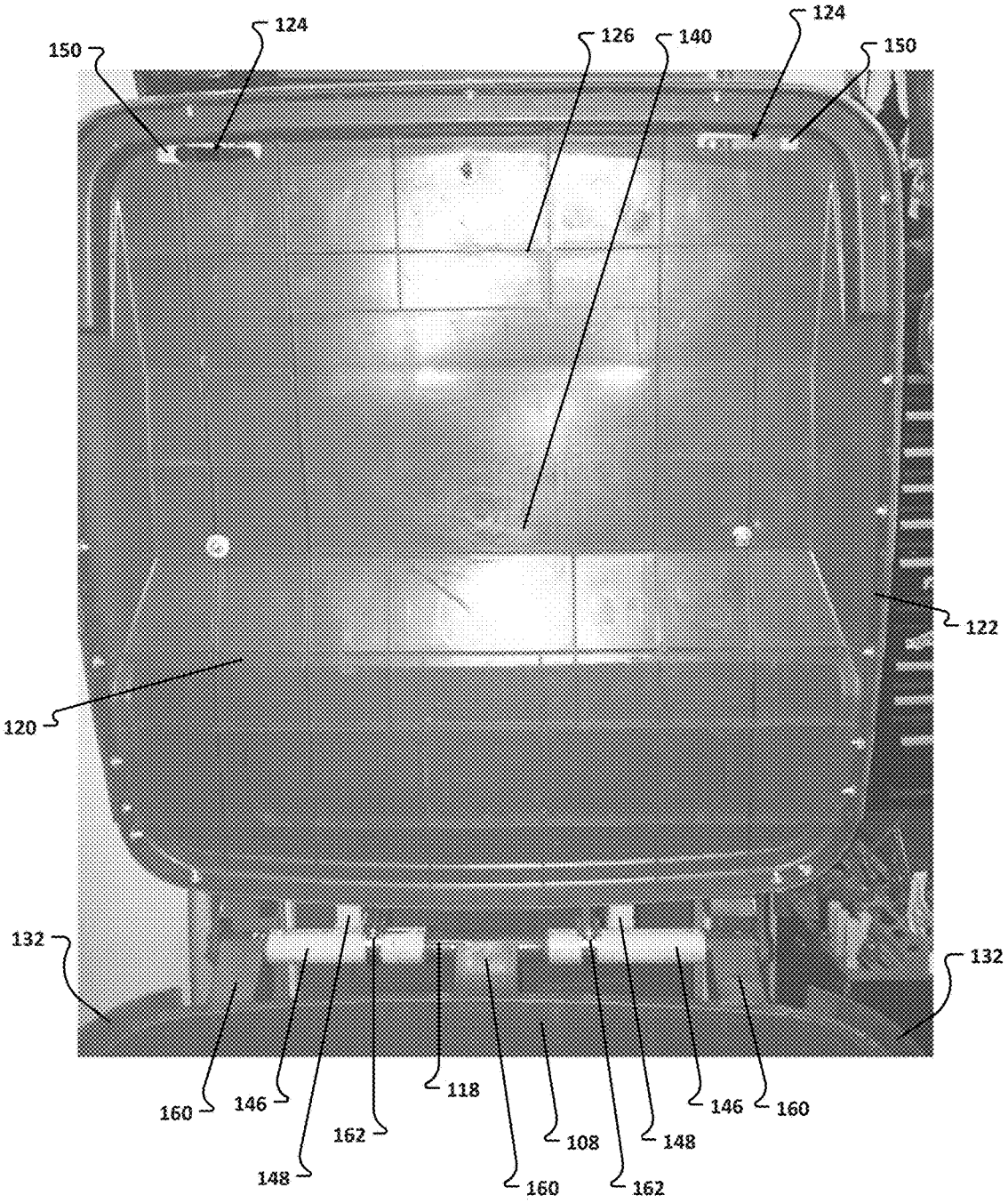
FIG. 11 is a view of the bottom of the open lid of the bear-resistant waste disposal container of the embodiment of FIG. 1, showing two apertures therein as well as a plurality of bolts securing the lid collar around the downwardly extending perimeter thereof.

The one or more pickets 126 may be positioned (e.g. by fixedly securing the picket plates 140 thereof to an inner surface of the bin 102 that is) adjacent a surface of the front wall 106 of the bin 102 (e.g. a surface opposite the rear wall 108 from which the handle 118 of the bear-resistant waste disposal container 100 extends) (see, e.g., FIGS. 8-10). In embodiments, the bear-resistant waste disposal container 100 comprises two pickets 126, one secured to a surface of the front wall 106 of the bin 102 adjacent the first side wall 110 of the bin 102, and the other secured to a surface of the front wall 106 of the bin 102 adjacent the second side wall 112 of the bin 102. In other embodiments, the bear-resistant waste disposal container 100 comprises only one picket 126, positioned near the approximate center of the inside surface of the front wall 106 of the bin 102. In still other embodiments, the bear-resistant waste disposal container 100 comprises three pickets 126, one each positioned near the approximate center of the inside surface of the front wall 106 of the bin 102, the approximate center of the inside surface on the first side wall 110 of the bin 102, and the approximate center of the inside surface on the second side wall 112 of the bin 102. In some embodiments, the lid 120 of the bear-resistant waste disposal container 100 may not be connected to the bin 102 (whether via the handle 118 or otherwise). In such embodiments in particular, a plurality of pickets 126 may be positioned at intervals around the perimeter of the outer wall of the bin.

In some embodiments of the bear-resistant waste disposal container 100, the picket plate(s) 140 may be secured to an upper inside surface of the bin 102, to reduce the height (and thus to increase the strength) of the upper portion of the picket 126 (see, e.g., FIG. 10).

The bear-resistant waste disposal container 100 further includes a lid frame 144 (see, e.g., FIGS. 1-4, 12-13). In embodiments, the lid frame 144 comprises at least one rotatable connection member 146 that rotatably secures the lid frame 144 to the handle 118; at least one frame member 148 fixedly secured to the at least one rotatable connection member 146, and at least one plate member 150 fixedly secured to the at least one frame member 148. Each of these components will be discussed in further detail below.

Figure 6:
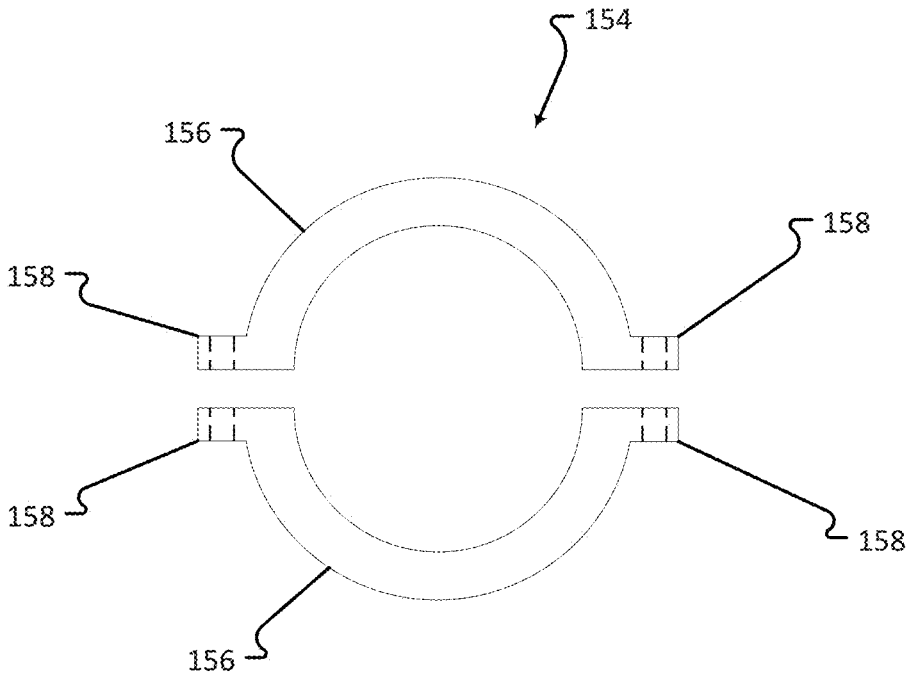
FIG. 6 is a side view of a rotatable connection member of a lid frame that may be used in embodiments of the present disclosure.
Figure 7:
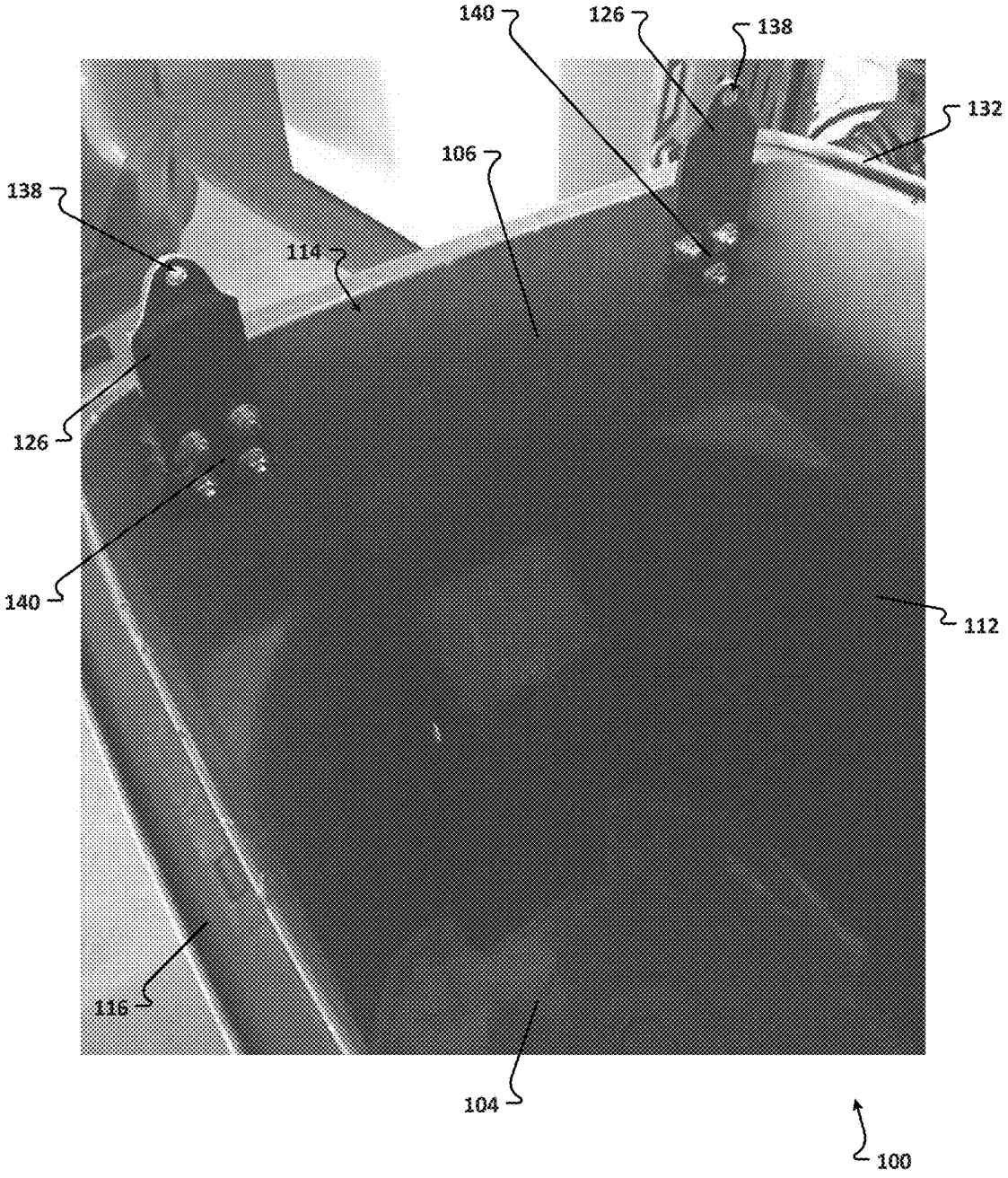
FIG. 7 is a view of the front inner surface of the bear-resistant waste disposal container of the embodiment of FIG. 1 with the lid open, showing two pickets fixedly secured thereto.
Figure 12:
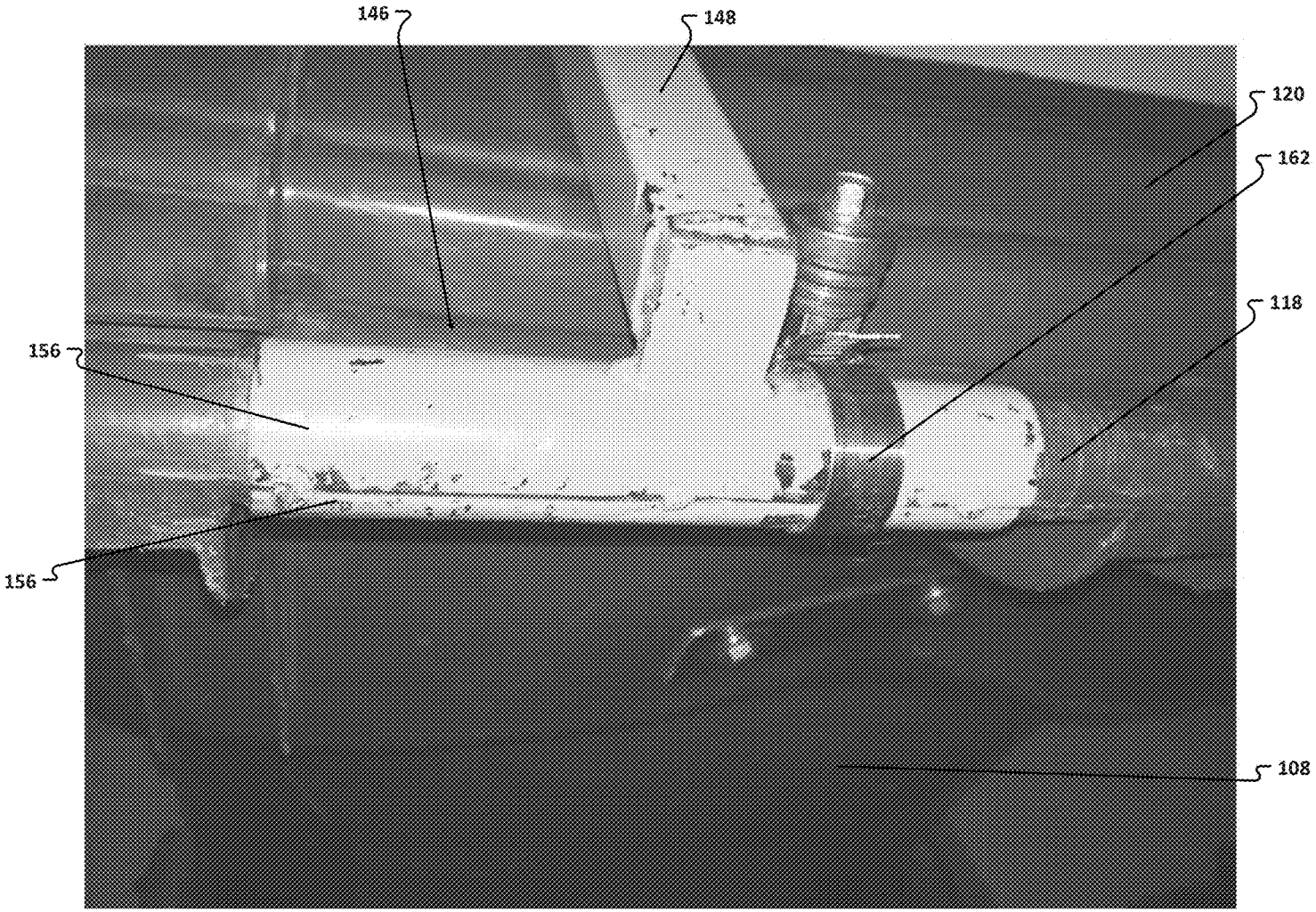
FIG. 12 is a close-up view of a rotatable connection member rotatably connected to the handle of the bear-resistant waste disposal container of the embodiment of FIG. 1, showing a frame member fixedly secured to the rotatable connection member.
Figure 13:
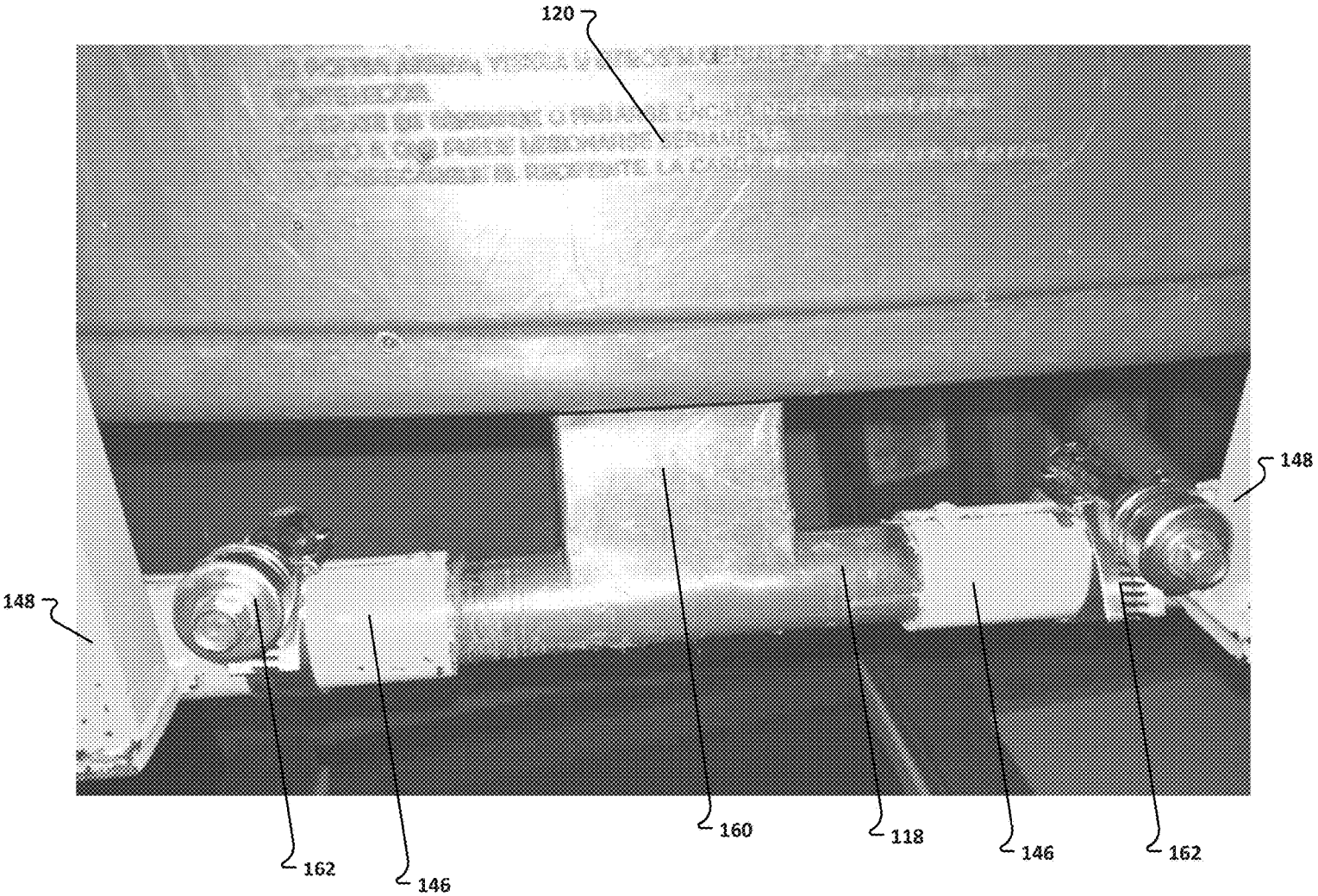
FIG. 13 is a top close-up view of a center portion of the handle of the bear-resistant waste disposal container of the embodiment of FIG. 1, showing a portion of each of two rotatable connection members rotatably connected to the handle.
Figure 14:
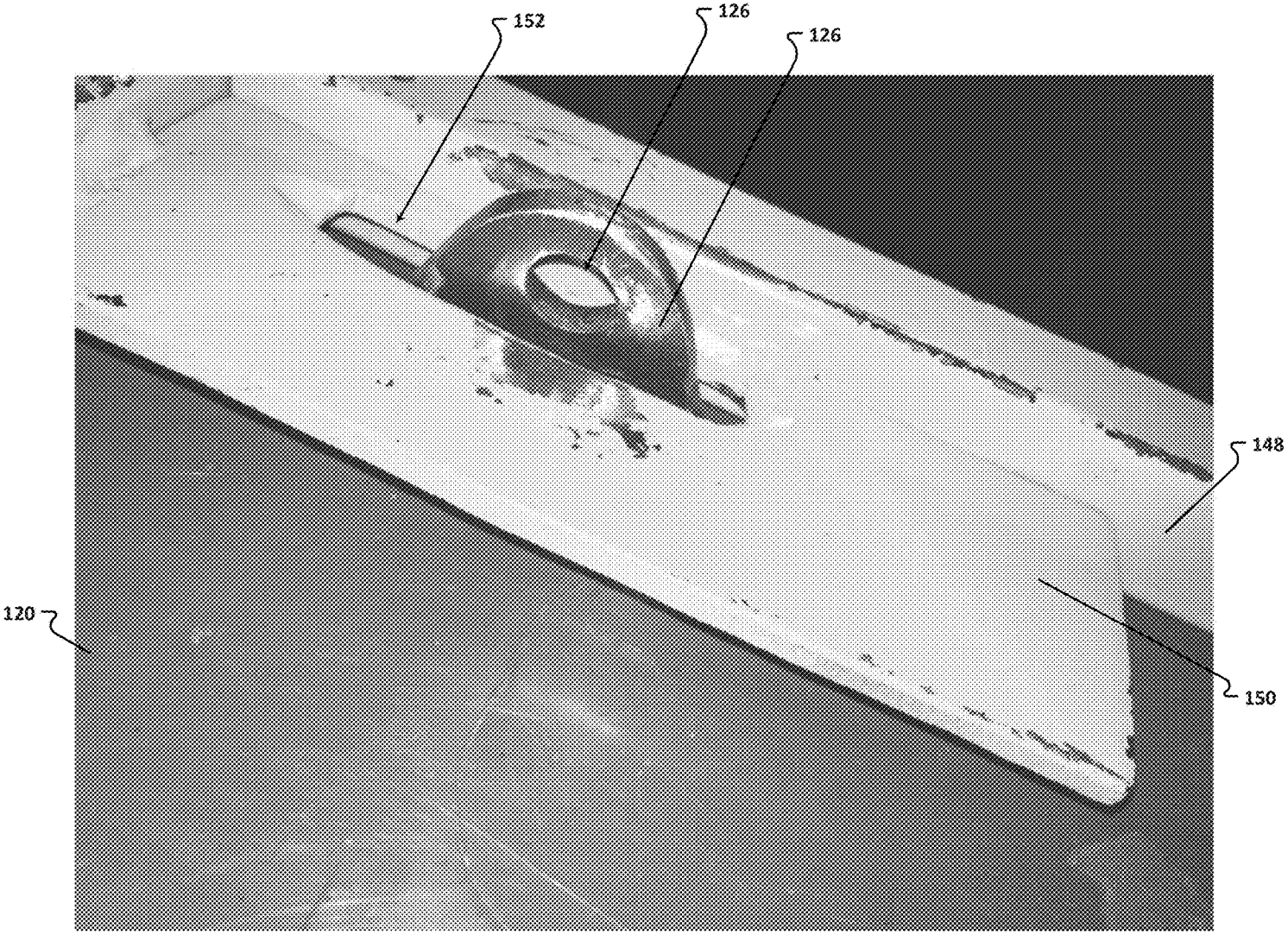
FIG. 14 is a close-up view of a plate member of the lid frame of the bear-resistant waste disposal container of the embodiment of FIG. 1, showing the upper portion of a picket extending through an aperture thereof.

The at least one rotatable connection member 146 allows the lid frame 144 to rotate about the same axis of rotation as the lid 120 (see, e.g., FIGS. 12-13). In some embodiments, for example, both the lid 120 and the lid frame 144 are rotatably connected to and rotate about the handle 118, which forms an axis of rotation. For example, for bear-resistant waste disposal containers 100 having a cylindrical handle 118, the at least one rotatable connection member 146 of the lid frame 144 may comprise at least one tubular member 154 that fits around the handle 118 and allows the lid frame 144 to rotate around the handle 118. The tubular member 154 may comprise, for example, a steel tube that has been cut in half along a plane that includes the axis of the tube. The two halves 156 may then be reattached around the handle 118, such that the handle 118 passes through the center of the re-formed steel tube (the tubular member 154), and the re-formed steel tube can rotate around the handle 118. The two halves 156 may be reattached in any suitable manner, including welding or clamping. For example, the two halves 156 may be tack, bead, or stitch welded together at certain points where they come together. Additionally or alternatively, one or more pipe clamps 162 may be used to hold the two halves 156 together. As another alternative, each tube half 156 may comprise a flange or lip 158 that extends in a radial direction from the longitudinal edges of the tube half 156, such that when the tube halves 156 are assembled around the handle 118, the lips 158 of one tube half 156 are substantially adjacent to the lips 158 of the other tube half 156 (see, e.g., FIG. 6). The lips 158 can then be bolted or clamped together in a removable attachment. Alternatively, a lip 158 from one of the tube halves 156 may be hingedly connected to the adjacent lip 158 from the other of the tube halves 156, such that the tube halves 156 can be closed (in which position they form a complete tube) or opened (e.g. so as to be placed around the handle 118). In the closed position, the lips 158 opposite the hingedly connected lips may be bolted, clamped, or otherwise removably attached together to secure the tube halves 156 in the closed position.

In embodiments of the bear-resistant waste disposal container 100, the handle 118 may be secured to the bin 102 with three supports 160—one on each end of the handle 118 and one in the center of the handle 118 (see, e.g., FIGS. 2, 13). In such embodiments, the lid frame 144 may comprise two rotatable connection members 146, each secured to the handle 118 in between two of the three supports 160. In any embodiment, the rotatable connection member 146 may comprise at least a portion of a steel tube, which may have a thickness of at least one sixteenth of an inch, at least one eighth of an inch, or at least one quarter of an inch. The rotatable connection member 146 may have an inner diameter slightly greater than the outer diameter of the handle 118.

In embodiments where the lid 120 is not rotatably or otherwise connected to the bin 102 (whether via the handle 118 or otherwise), the lid frame 144 may not comprise a rotatable connection member. In such embodiments, the remaining components of the lid frame 144 may be secured directly to the lid 120. On or more attachment plates 142 may be used in such embodiments to prevent the bolts, screws, rivets, or other fasteners used to attach the lid frame 144 to the lid 120 from tearing through the material of the lid 120.

The lid frame 144 also comprises at least one frame member 148 fixedly secured to and extending from the rotatable connection member 146. The at least one frame member 148 may be welded to the rotatable connection member 146. Additionally or alternatively, the at least one frame member 148 may be clamped, bolted, screwed, adhered (e.g. using adhesive) or otherwise secured to the rotatable connection member 146. As noted above, the at least one frame member 148 may be secured directly to the lid 120 in some embodiments, particularly where the lid 120 is not rotatably (or otherwise) secured to the bin 102.

The at least one frame member 148 may be made of any suitable material. In some embodiments, the at least one frame member 148 is made of tubing having a substantially square or rectangular cross-section, while in other embodiments the at least one frame member 148 is made of tubing having a substantially circular cross-section. The at least one frame member 148 may be, for example, one inch by one inch square steel tubing. The at least one frame member 148 may also be made of aluminum, a carbon-fiber composite, high-density polyethylene, or any other suitable material.

In some embodiments, the lid frame 144 comprises a plurality of frame members 148, at least one of which is fixedly secured to the at least one rotatable connection member 146. The plurality of frame members 148 may be arranged to extend along some or all of the edges of the lid 120, along with any needed cross-bracing to provide adequate stiffness. The plurality of frame members 148 may, for example, be arranged in a substantially rectangular shape for a rectangular lid 120, a substantially square shape for a square lid 120, or a substantially circular shape for a circular lid 120. The plurality of frame members 148 may extend over one or more edges of the lid 120, or the plurality of frame members 148 may be positioned within the outer perimeter of the lid 120. The plurality of frame members 148 may be welded together, or they may be bolted, screwed, clamped, riveted, adhered, or otherwise fixedly secured to each other.

Whether instead of or in addition to be fixedly secured to the rotatable connection member 146, the at least one frame member 148 (whether the at least one frame member 148 or at least one of the plurality of frame members 148) may be bolted, screwed, clamped, adhered, riveted, welded, or otherwise affixed to the lid 120. An attachment plate 142 may be placed on the underside of the lid 120 opposite one or more points of attachment of the lid frame 144 to the lid 120, and a bolt, screw, or pop rivet may be used to attached the lid frame 144 to the attachment plate 142 through the lid 120, such that a portion of the lid 120 is sandwiched between the lid frame 144 and the attachment plate 142.

Also forming part of the lid frame 144, and fixedly secured to the at least one frame member 148, is the at least one plate member 150 (see, e.g., FIGS. 1, 2, 4, and 14). The at least one plate member 150 may be oriented in a substantially horizontal plane. The at least one plate member 150 may have an aperture 152 and may be positioned over the lid 120 so that the aperture 124 of the lid 120 aligns or substantially aligns with the aperture 152 of the plate member 150. The plate member 150 may cover the area of the lid 120 surrounding the aperture 124 in the lid 120 so as to prevent a bear or other animal from accessing and enlarging the aperture 124 in the lid 120. The plate member 150 may also act as a gusset for the portion of the lid 120 having the aperture 124. When the lid 120 (together with the lid frame 144) is closed, the upper portion of the at least one picket 126 extends through the aperture 124 of the lid 120 and through the aperture 152 of the plate member 150. The plate member 150 may be positioned at a particular height above the lid 120 so that a lower surface of the opening 138 of the picket 126 is substantially coplanar with an upper surface of the plate member 150. The plate member 150 may be welded, bolted, screwed, riveted, adhered, or otherwise fixedly secure to the at least one frame member 148.

In some embodiments, the at least one frame member 148 may be positioned so that when the lid 120 (together with the lid frame 144) is closed, a portion of the at least one frame member 148 is adjacent the upper portion of the at least one picket 126. The at least one frame member 148 may further have a hole or opening that aligns with the opening 138 in the upper portion of the at least picket 126. In such embodiments, a plate member 150 may not be needed. In still other embodiments, the plate member 150 may be oriented in a vertical plane, and may be fixedly secured to the at least one frame member 148 so that when the lid 120 (together with the lid frame 144) is closed, an aperture 152 of the plate member 150 aligns with the opening 138 of the at least one picket 126.

The plate member 150 may comprise steel, aluminum, a carbon-fiber composite, high-density polyethylene, or any other suitable material. For example, the plate member 150 may comprise steel plating having a thickness of at least one eight of an inch, at least one quarter of an inch, or at least three eighths of an inch. The plate member 150 may be fixedly secured to the at least one frame member 148 along at least two sides of the plate member 150, or along at least three sides of the plate member 150, or along the entire outer perimeter of the plate member 150.

A bear-resistant waste disposal container 100 according to embodiments of the present disclosure further includes a locking device 164. The locking device 164 may be, for example, a carabiner (see, e.g., FIGS. 1-4). With the lid 120 (together with the lid frame 144) in the closed position, the carabiner may be inserted through the opening 138 in the upper portion of the picket 126. When so installed, the carabiner prevents the picket 126 from sliding through the aperture 152 in the plate member 150, and thus locks the lid 120 in the closed position. In embodiments without a plate member 150, where the frame member 148 comprises a hole or opening that substantially aligns with the opening 138 in the picket 126, the carabiner may be inserted through both openings, thus locking the lid frame 144 to the picket 126 and locking the lid 120 in the closed position. Likewise, in embodiments with the plate member 150 oriented in a vertical plane, such that the aperture 152 of the plate member 150 substantially aligns with the opening 138 of the picket 126, the carabiner can be inserted through opening 138 of the picket 126 and through the aperture 152 of the plate member 150, thus locking the lid frame 144 to the picket 126 and locking the lid 120 in the closed position. In any of the foregoing embodiments, the lid 120 can be unlocked by removing the locking device 164, whether the locking device 164 is a carabiner or otherwise. The locking device 164 (here, the carabiner) may be attached to the bin 102, the lid 120, the handle 118, the lid frame 144, or any component of the foregoing using a steel wire 166 (e.g. lock wire) or the like so that the locking device 164 remains attached to the bear-resistant waste disposal container 100 even when not hooked onto the picket 126. In embodiments of the bear-resistant waste disposal container 100 comprising multiple materials, the locking device 164 may be attached to the strongest of the materials (via a steel wire 166 or the like) to ensure the greatest durability. For example, if the lid 120 is made of high density polyethylene, and the lid frame 144 is made of tubular steel, the locking device 164 may be attached via steel wire 166 to the lid frame 144. Then, if a large force is exerted on the steel wire 166, the steel tubing of the lid frame 144 will be less likely to break than the high density polyethylene might be if the steel wire 166 had been attached to the lid 120.

As persons ordinarily skilled in the art will recognize based on the foregoing disclosure, in embodiments of the bear-resistant waste disposal container 100 having two, three, or more pickets 126, the lid frame 144 will have a corresponding number of plate members 150 (or, alternatively, at least one plate member 150 with a corresponding number of apertures 152), with each plate member aligned so that an aperture thereof is configured to receive a picket 126 when the lid 120 is closed. In such embodiments, the lid 120 will also have a number of apertures corresponding to, and aligned with, the plurality of pickets 126. Additionally, such bear-resistant waste disposal containers 100 are equipped with a carabiner or other locking device 164 for each picket 126.

Other locking devices 164 may also be used. For example, a bolt or pin could be inserted into the opening of the picket 126 to lock the lid 120 in the closed position. Such a bolt or pin could be loosely connected to the bear-resistant waste disposal container 100 using steel wire 166 (e.g. lock wire) or the like, or the bolt or pin could be slidably mounted to the at least one frame member 148 or to the at least one plate member 150, in a position that would allow a user of the bear-resistant waste disposal container 100 to slide the bolt or pin into the picket opening 138 when the lid 120 is closed, and out of the picket opening 138 when the lid 120 needs to be opened. Additionally, the bolt or pin could be spring-loaded or otherwise biased to the closed position, and provided with an inclined surface at one end, so that when the lid 120 is closed, the picket 126 pushes against the inclined surface and causes the bolt or pin to retract, compressing the spring or other biasing member. When the lid 120 is fully closed and the bolt or pin is aligned with the picket opening 138, the compressed spring may then push the bolt or pin into the picket opening 138, thus locking the lid 120 in the closed position. The bolt or pin may further include a tab extending therefrom that allows a user to push the bolt or pin out of the picket opening 138 (thus compressing the spring) to allow the lid 120 to open.

Figure 5:
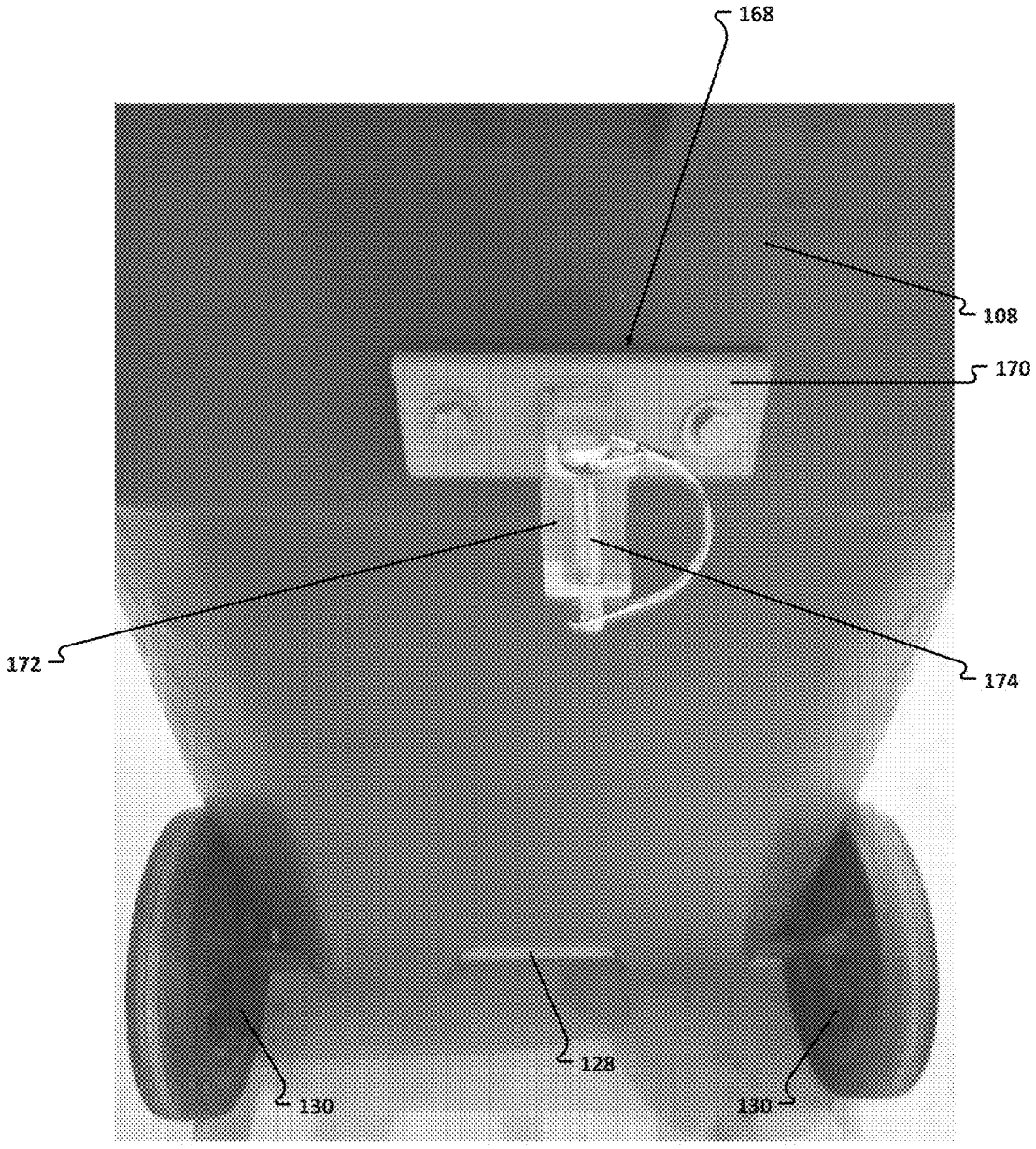
FIG. 5 is a view of an attachment mechanism attached to a rear wall of the bear-resistant waste disposal container of the embodiment of FIG. 1.

In embodiments, a bear-resistant waste disposal container 100 of the present disclosure further includes an attachment mechanism 168 that allows the container 100 to be removably secured in a particular location (e.g. to prevent bears from lifting, rolling, or otherwise moving or removing the bear-resistant waste disposal container 100) (see, e.g., FIG. 5). The attachment mechanism 168 may comprise, for example, an outer plate 170 positioned on an outer surface of the rear wall 108 of the bin 102, the outer plate 170 bolted to an attachment plate 142 positioned on an inside surface of the rear wall 108 of the bin 102 opposite the outer plate 170, such that a portion of the rear wall 108 of the bin 102 is sandwiched between the outer plate 170 and the attachment plate 142. Alternatively, the outer plate 170 and the attachment plate 142 may be riveted together, or joined using any other suitable method of attachment.

The attachment mechanism 168 may further comprise a bracket 172 extending from the outer plate 170, the bracket 172 having an upper arm and a lower arm (or, in embodiments, a left arm and a right arm). The bracket 172 may be welded to the outer plate 170, or attached via other suitable means (including, for example, bolting, screwing, riveting, adhering, and the like) A bolt or pin 174 may be inserted through an opening in each arm of the bracket 172 and held in place with a locknut, a cotter pin, safety wire, or the like. In some embodiment, the bolt or pin 174 may be a quick-locking pin, a lock pin, or a clevis pin. In use, the attachment mechanism 168 can be used to secure the bear-resistant waste disposal container 100 to a rope, a fence, a post, or another suitable object.

The outer plate 170 of the attachment mechanism 168, together with the bracket 172 and the various attachment plates 142 described herein, may be made of steel, aluminum, a carbon-fiber composite, high-density polyethylene, or any other suitable material.

Additionally, one or more reflectors 176, reflector tape, or other visibility-enhancing products may be affixed to the lid frame 144 or other portions of the bear-resistant waste disposal container 100 (see, e.g., FIG. 2). Such products may be particularly helpful for bear-resistant waste disposal containers 100 intended for use with curbside pickup services or in any other setting where the container 100 will be positioned adjacent a road.

In some embodiments, the lid frame 144 may be detached from the lid 120 and rotated around the handle 118 until it hangs directly from the handle 118. This may facilitate opening and closing of the lid 120 when security from bears or other large wildlife is not an issue, such as during bear hibernation season or if the bear-resistant waste disposal container 100 is being used indoors. In still other embodiments, the lid frame 144 may be completely removed from the container 100, and reinstalled as needed.

As persons of ordinary skill in the art will recognize based on the foregoing disclosure, commercially available waste disposal containers (including, for example, 96-gallon curbside residential refuse bins and other standardized disposal containers) can be retrofitted with a bin collar 132, lid collar 136, lid frame 144, one or more pickets 126, a locking device 164, and an attachment mechanism 168 to create a bear-resistant waste disposal container 100 as described herein. Such a retrofit provides an economical way to obtain a bear-resistant trash can, and helps to conserve existing resources by re-using a refuse bin that might otherwise be thrown away.

A number of variations and modifications of the disclosure can be used. It would be possible to provide for some features of the disclosure without providing others.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A bear-resistant waste container comprising:

a bin comprising:

an outer wall;

an open top surrounded by a substantially horizontal surface; and a handle extending from the outer wall near the open top;

a lid movably connected to the bin and movable between a closed position and an open position, the lid comprising:

an upper surface surrounded by a downwardly extending perimeter, wherein a bottom portion of the downwardly extending perimeter is adjacent the substantially horizontal surface when the lid is in the closed position; and at least one lid aperture in the upper surface;

a bin collar fixedly secured to at least a portion of a perimeter of the substantially horizontal surface, the bin collar extending vertically above the substantially horizontal surface by at least one half of one inch;

a lid frame positioned adjacent the lid and comprising:

at least one connection member that allows the lid frame to move with the lid;

at least one frame member fixedly secured to the at least one connection member; and at least one plate member comprising at least one plate aperture and fixedly secured to the at least one frame member, the at least one plate member positioned to align the at least one plate aperture with the at least one lid aperture;

at least one picket fixedly secured to the outer wall and configured to extend upward past the open top and through the lid aperture and the plate aperture when the lid is in the closed position, the at least one picket comprising an opening in an upper portion thereof; and a locking device attached to one of the bin, the lid, the bin collar, and the lid frame, the locking device removably insertable through the opening of the at least one picket to secure the lid in the closed position.

2. The bear-resistant waste container of claim 1, wherein the lid is rotatably connected to the handle of the bin.

3. The bear-resistant waste container of claim 1, wherein the bottom portion of the downwardly extending perimeter contacts the substantially horizontal surface when the lid is in the closed position.

4. The bear-resistant waste container of claim 1, further comprising a lid collar fixedly secured to at least a portion of an outer surface of the downwardly extending perimeter, the lid collar comprising a lower edge substantially aligned with a lower surface of the downwardly extending perimeter, such that the lower edge is lower than an upper edge of the bin collar when the lid is in the closed position.

5. The bear-resistant waste container of claim 4, wherein the bin collar and the lid collar are made of steel.

6. The bear-resistant waste container of claim 1, wherein the lid frame is rotatably connected to the handle.

7. The bear-resistant waste container of claim 1, wherein the picket comprises a plate portion fixedly secured to an attachment plate, the plate portion positioned on an inner surface of the outer wall and the attachment plate positioned on an outer surface of the outer wall.

8. The bear-resistant waste container of claim 1, further comprising an attachment mechanism fixedly secured to an attachment plate, the attachment mechanism positioned on an outer surface of the outer wall and the attachment plate positioned on an inner surface of the outer wall.

9. The bear-resistant waste container of claim 1, wherein the locking device is a carabiner.

10. The bear-resistant waste container of claim 1, wherein the locking device comprises a biased member.

11. The bear-resistant waste container of claim 1, wherein the bin collar, the lid frame, and the picket are formed of a different material than the bin.

12. The bear-resistant waste container of claim 1, wherein the bin further comprises:

an axle secured to a bottom portion of the bin; and two wheels rotatably mounted on the axle.

13. The bear-resistant waste container of claim 1, further comprising:

at least two lid apertures in the upper surface of the lid;

at least two pickets; and at least two locking devices.

14. A reinforced garbage can comprising:

a bin for receiving garbage, the bin comprising:

an interior volume defined by a bottom surface and an outer wall, the outer wall comprising a handle;

an open top; and a lid rotatably attached to the handle near the open top, the lid comprising an upper surface with a first aperture therein, the lid movable between an open position in which the interior volume is accessible and a closed position in which the interior volume is inaccessible;

a reinforcing frame secured to the bin, the reinforcing frame comprising:

a rotatable connection member rotatably attached to the handle;

at least one frame member positioned adjacent an upper surface of the lid and fixedly secured to the rotatable connection member; and at least one plate member fixedly secured to the at least one frame member, the at least one plate member comprising a second aperture;

a picket fixedly secured to the outer wall and positioned to extend upwardly through the first and second apertures when the lid is in the closed position, the picket comprising an opening positioned above the second aperture when the lid is in the closed position; and a locking device selectively insertable through the opening of the picket to prevent the picket from passing through the second aperture, thus securing the lid in the closed position.

15. The reinforced garbage can of claim 14, wherein the picket is further fixedly secured to an attachment plate positioned on an opposite side of the outer wall from the picket.

16. The reinforced garbage can of claim 14, further comprising:

a bin collar fixedly secured to the outer wall and having an upper edge at least one half of one inch above the open top; and a lid collar fixedly secured to a downwardly extending perimeter of the lid and having a lower edge;

wherein when the lid is in the closed position, the bin collar is positioned outside of the lid collar, and the upper edge of the bin collar is higher than the lower edge of the lid collar.

17. A bear-resistant waste disposal container comprising:

a bin comprising:

a bottom surface;

a front wall;

a rear wall;

a first side wall;

a second side wall; and an open top surrounded by a substantially horizontal surface;

a handle extending from the rear wall near the open top;

a lid rotatably connected to the handle and movable between a closed position and an opened position, the lid comprising:

an aperture in an upper surface of the lid; and a downwardly extending perimeter, at least a portion of which contacts the substantially horizontal surface when the lid is in the closed position;

a bin collar fixedly secured to at least a portion of a perimeter of the substantially horizontal surface, the bin collar extending vertically above the substantially horizontal surface by at least one half of an inch;

a lid collar fixedly secured to at least a portion of an outer surface of the downwardly extending perimeter, the lid collar comprising a lower edge substantially aligned with a lower surface of the downwardly extending perimeter, such that the lower edge is lower than an upper edge of the bin collar when the lid is in the closed position;

at least one picket comprising:

an upper portion having an opening therein, the upper portion extending vertically through the aperture of the lid; and a lower portion comprising a picket plate, the picket plate fixedly secured to one of the front wall, the first side wall, or the second side wall of the bin;

a lid frame, the lid frame comprising:

at least one rotatable connection member rotatably connected to the handle;

at least one frame member fixedly secured to the rotatable connection member; and at least one plate member comprising a second aperture, the at least one plate member fixedly secured to the at least one frame member and positioned so that the upper portion of the at least one picket extends through the second aperture of the plate member when the lid is in the closed position;

a locking device attached to one of the lid frame, the lid, the bin, and the handle, the locking device removably insertable through the opening of the picket to lock the lid in the closed position; and an attachment mechanism fixedly secured to the rear wall of the bin.

18. The bear-resistant waste disposal container of claim 17, wherein the bin collar and the lid collar are made of steel.

* * * * *